US010875682B1

(12) United States Patent
Laudon et al.

(10) Patent No.: US 10,875,682 B1
(45) Date of Patent: Dec. 29, 2020

(54) AUXILIARY GRIPPING MEMBER

(71) Applicants: James Laudon, Clearwater, FL (US); Ryan Christopher Jones, Clearwater, FL (US)

(72) Inventors: James Laudon, Clearwater, FL (US); Ryan Christopher Jones, Clearwater, FL (US)

(73) Assignee: James Laudon, Clearwater, FL (US)

( * ) Notice: Subject to any disclaimer, the term of this patent is extended or adjusted under 35 U.S.C. 154(b) by 0 days.

(21) Appl. No.: 16/592,590

(22) Filed: Oct. 3, 2019

(51) Int. Cl.
*B25G 1/00* (2006.01)
*B65D 25/32* (2006.01)

(52) U.S. Cl.
CPC ..... *B65D 25/32* (2013.01); *B65D 2525/289* (2013.01)

(58) Field of Classification Search
CPC . Y10T 16/4576; Y10T 16/469; Y10T 16/466; Y10T 16/4724; A45F 5/00; A45F 5/102; A45F 5/1026; A45F 5/10; A45F 2005/1053; A45F 2005/1033; A47F 13/085; B65G 7/12; B65D 25/32; B65D 2525/289
See application file for complete search history.

(56) References Cited

U.S. PATENT DOCUMENTS 614,173 A * 11/1898 Kelly ..... A45F 5/1046 294/171
2,821,739 A * 2/1958 Mohs ..... A45F 5/1046 16/411
3,072,955 A * 1/1963 Mitchell ..... B25G 1/105 294/171
3,635,382 A * 1/1972 Wilson ..... A45F 5/102 294/166
4,823,433 A * 4/1989 Curtis ..... B44D 3/14 16/411
5,368,393 A * 11/1994 Normann ..... A45F 5/1026 294/170
5,492,425 A * 2/1996 Carter ..... A47L 13/17 401/10
D372,865 S * 8/1996 Stowell ..... A45F 5/1046 D9/434
5,601,327 A * 2/1997 Cho ..... A45F 5/1046 294/137

(Continued)

FOREIGN PATENT DOCUMENTS

GB 2349072 A * 10/2000 ..... A45F 5/1046
JP 2003231526 A * 8/2003 ..... A45F 5/1046
WO WO-2006105551 A1 * 10/2006 ..... A45F 5/1046

*Primary Examiner* — Chuck Y Mah

(57) ABSTRACT

An inner collar is co-axially aligned with a longitudinal axis of an outer collar. The outer and inner collars are and separated by a gap. A plurality of ribs disposed within the gap and interconnect the inner collar to the outer collar. The inner collar defining an interior passage. A channel disposed within the outer collar and the inner collar. The channel extending along the longitudinal axis and opening at one side into the passage and opening at an opposite side exteriorly of the outer collar. The outer collar, inner collar, and plurality of ribs are constructed of a resiliently deformable material thereby allowing the outer and inner collars to resiliently deform for removably receiving a tubular container grip and allowing the outer collar and the plurality of ribs to resiliently deform for increasing gripping capabilities of a human hand.

12 Claims, 7 Drawing Sheets

(56) References Cited

U.S. PATENT DOCUMENTS

| | | | | |
|---|---|---|---|---|
| 5,738,401 | A * | 4/1998 | Fan | A45F 5/1046 294/137 |
| 6,648,535 | B2 * | 11/2003 | Ferrara, Jr. | B25G 1/102 16/421 |
| 7,805,813 | B1 * | 10/2010 | Bunyard | A47J 45/072 16/425 |
| 9,290,037 | B2 * | 3/2016 | Vleisides | B43K 23/008 |
| 2003/0102684 | A1 * | 6/2003 | Shinmoto | A45F 5/1046 294/171 |
| 2006/0064851 | A1 * | 3/2006 | Kincaid | A45F 5/1046 16/435 |
| 2007/0209161 | A1 * | 9/2007 | Neering | B43K 23/004 16/422 |
| 2008/0289148 | A1 * | 11/2008 | Summerfield | A45F 5/102 16/421 |
| 2015/0053705 | A1 * | 2/2015 | Wilson | A47J 47/18 220/755 |

* cited by examiner

AUXILIARY GRIPPING MEMBER

BACKGROUND OF THE INVENTION

Field of the Invention

The present invention relates to handles of carriable containers and buckets. More specifically, the present invention pertains to an auxiliary gripping member which is resiliently deformable for removably receiving tubular container grips (also referred to herein as "tubular gripping implements" and "tubular grips") and for increasing gripping capabilities. The receiving of tubular container grips and the increasing of gripping capabilities are done in a safe, convenient, ergonomic, and economical manner.

Description of the Prior Art

The use of carriable containers and paint buckets which utilize a variety of carrying members, such as wire handles, wire bails, and like plastic handles with tubular gripping implements for transporting purposes are well known in the prior art. More specifically, there are also various gripping apparatuses well known in the prior art which are previously devised and utilized for the purpose of receiving and retrofitting such carrying members and tubular gripping implements.

While these known gripping apparatuses fulfill their respective, particular objectives and requirements of providing a larger diameter grip for the hand of a user, they do not describe an auxiliary gripping member which is both removably receivable and resiliently deformable. The gripping apparatuses of the prior art lack the capability of resilient deformation which can significantly increase gripability. Furthermore, the gripping apparatuses of the prior art comprise of multiple components which are problematic when receiving and retrofitting tubular gripping implements. It is known that these gripping apparatuses do provide a larger diameter grip for the user which has been shown to increase gripability and reduce potential injuries. However, the rigid materials which these gripping apparatuses are made from limit the user's potential gripping capabilities, comfort, and in some instances cause hand and arm related injuries.

In this respect, the auxiliary gripping member according to the present invention substantially departs from the conventional concepts and designs of the prior art, and in doing so provides a resiliently deformable auxiliary gripping member which provides a multitude of user benefits. Such benefits primarily range from simplifying the process of removably receiving tubular gripping implements to increasing gripping capabilities by conforming to the user's hand when transporting heavy loads.

Therefore, it can be appreciated that there exists a continuing need for a new and improved auxiliary gripping member which is resiliently deformable for removably receiving annular container grips and for increasing gripping capabilities. In this regard, the present invention substantially fulfills this need.

SUMMARY OF THE INVENTION

In view of the disadvantages inherent in the known types of gripping apparatuses of known designs and configurations now present in the prior art, the present invention provides an improved auxiliary gripping member. As such, the general purpose of the present invention, which will be described subsequently in greater detail, is to provide a new and improved auxiliary gripping member and method of removably receiving container gripping implements which has all the advantages of the prior art and none of the disadvantages.

To attain this, from a broad perspective, the present invention includes an outer collar with a first end and a second end separated by a first length. An inner collar includes a first end, a second end, and an axis co-axially aligned with a longitudinal axis of the outer collar. The inner collar further defines a passage along the central axis. A gap is formed between the outer collar and the inner collar. A plurality of ribs disposed within the gap interconnect the inner collar to the outer collar. A channel disposed within the outer collar and the inner collar. The channel extending longitudally along the first length and opening at one side into the passage and opening at an opposite side exteriorly of the outer collar. The outer collar, the inner collar, and the plurality of ribs are constructed of a resiliently deformable material thereby allowing the outer collar and the plurality of ribs to resiliently deform when gripped by a user.

There has thus been outlined, rather broadly, the more important features of the invention in order that the detailed description thereof that follows may be better understood and in order that the present contribution to the art may be appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the invention be regarded as including such equivalent constructions insofar as they do not depart from the spirit and scope of the present invention.

It is therefore an object of the present invention to provide a new and improved auxiliary gripping member which has all the advantages of the prior gripping apparatuses of known designs and configurations and none of the disadvantages.

It is another object of the present invention to provide a new and improved auxiliary gripping member which may be easily and efficiently manufactured and marketed.

It is a further object of the present invention to provide a new and improved auxiliary gripping member which is constructed of durable and reliable materials which achieve the resilient deformation objective. Such materials may range from rubber or silicone to plastics with higher elasticities.

An even further object of the present invention is to provide a new and improved auxiliary gripping member which is susceptible of a low cost of manufacture with regard to both materials and labor, and which accordingly is then susceptible of low prices of sale to the consuming public, thereby making such auxiliary gripping member economically available.

Lastly, it is an object of the present invention to provide an auxiliary gripping member which is resiliently deformable for removably receiving tubular gripping implements and for increasing gripping capabilities. The removably receiving of gripping implements and the increasing of gripping capabilities are done in a safe, convenient, ergonomic, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
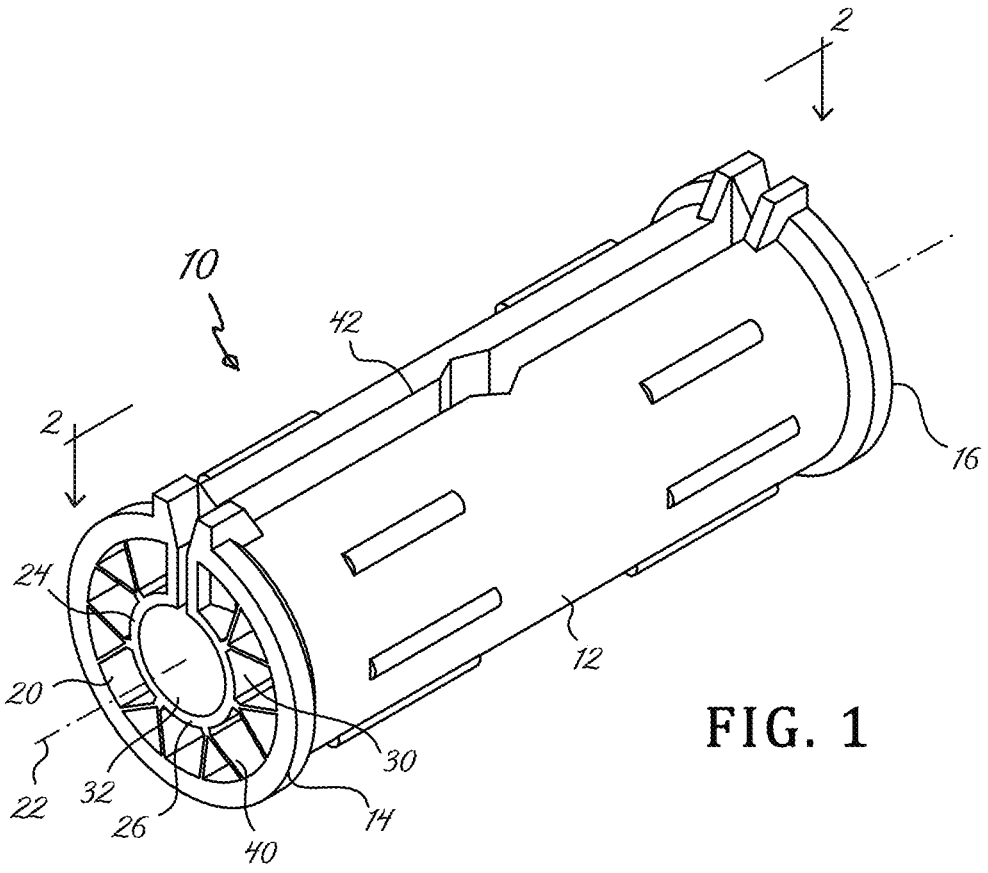
FIG. 1 is a perspective illustration of the auxiliary gripping member constructed in accordance with the principles of the present invention.

With reference now to the drawings, and in particular to FIG. 1 thereof, the preferred embodiment of the new and improved auxiliary gripping member embodying the principles and concepts of the present invention and generally designated by the reference numeral 10 will be described.

The present invention, the auxiliary gripping member 10, is comprised of a plurality of components. In their broadest context such include an outer collar, an inner collar, ribs, and a channel. Such components are individually configured and correlated with respect to each other so as to attain the desired objective.

In the preferred embodiment of the auxiliary gripping member, designated by reference numeral 10, first provided is an outer collar 12 constructed of a resiliently deformable material. The outer collar has a generally C-shaped configuration with a first end 14 and a second end 16 separated by a first length L1 therebetween. The outer collar has an exterior surface 18 with an exterior diameter and an interior surface 20 with an interior diameter. The outer collar further has a longitudinal axis 22.

Provided next is an inner collar 24 constructed of a resiliently deformable material. The inner collar has a generally C-shaped configuration with first end 26 and a second end 28. In this preferred embodiment, the first and second ends of the inner collar are in vertical alignment with the first and second ends of the outer collar respectively. Alternatively, the first and second ends of the inner collar do not have to be vertically aligned with the first and second ends of the outer collar to achieve the intended purpose of the invention. The inner collar has an exterior surface 30 with an exterior diameter and an interior surface 32 with an interior diameter. The interior surface of the inner collar defining a passage 34 which extends along an axis. The interior diameter of the inner collar is substantially dimensioned for positioning carrying members of the prior art within the passage.

The axis of the inner collar is co-axially aligned with the longitudinal axis of the outer collar. The interior diameter of the outer collar is greater than the exterior diameter of the inner collar thereby creating a gap 36 between the outer and inner collars.

Further provided are a plurality of ribs 40 constructed of a resiliently deformable material. The plurality of ribs are disposed within the gap and extend between the first end of the outer collar to the second end of the outer collar. The plurality of ribs radially interconnecting the exterior surface of the inner collar and the interior surface of the outer collar. Specifically, said interconnecting of the outer and inner collars is such that allows the outer collar and the plurality of ribs to resiliently deform when gripped by a hand of a user.

Lastly provided is a channel 42. The channel has a generally rectangular shape and is disposed within the outer collar and the inner collar. The channel extends longitudally along first length L1 and through the first and second ends of the inner collar and through the first and second ends of the outer collar. The channel opens interiorly at one side into passage 34 and opens at an opposite side exteriorly of the outer collar.

Figure 2:
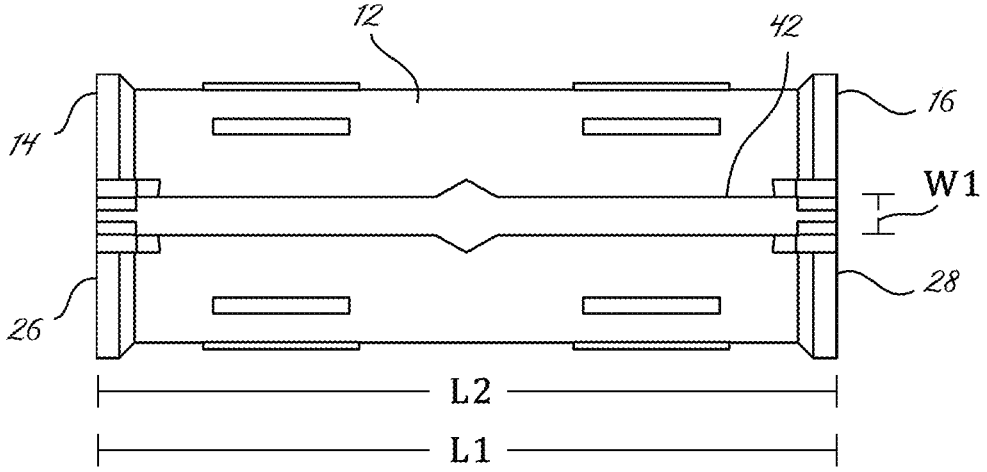
FIG. 2 is a plan view taken along lines 2-2 of FIG. 1.

As shown in FIG. 2, the channel has a channel length L2 which is substantially equal to first length L1. The channel also has a first width W1 which is perpendicular to channel length L2.

Figure 3A:
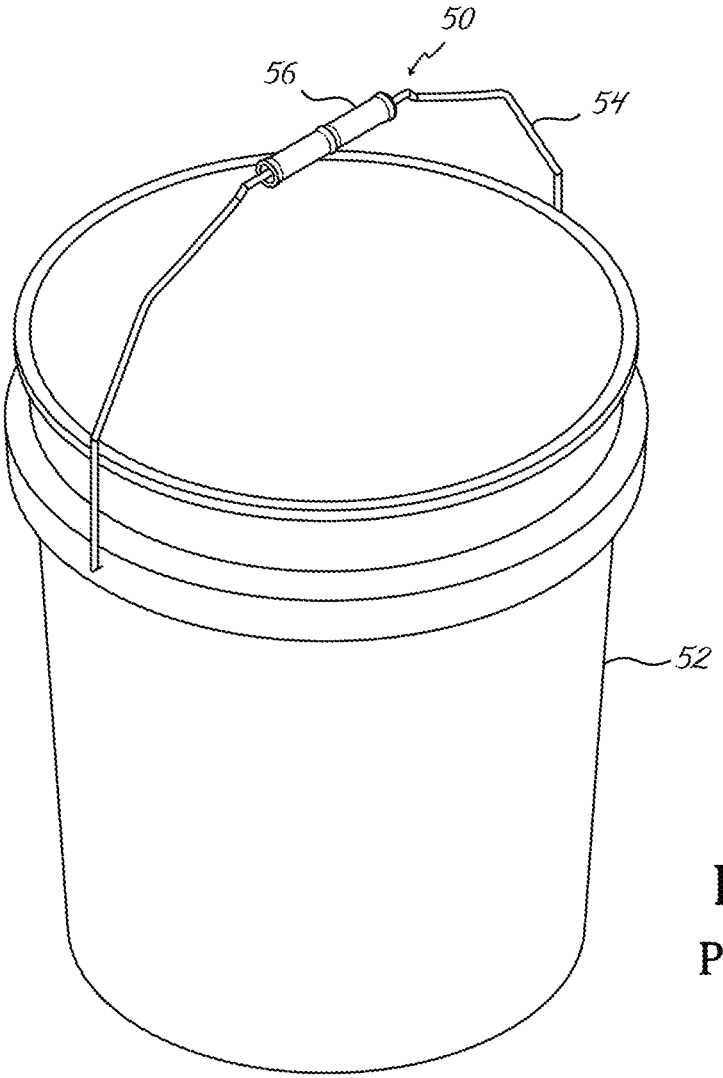
FIG. 3A PRIOR ART
FIG. 3A is a perspective illustration of a 5-gallon bucket known in the prior art with a wire handle and tubular grip.
Figure 3B:
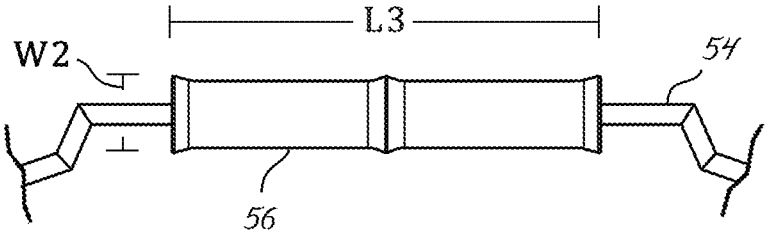
FIG. 3B PRIOR ART
FIG. 3B is an enlarged showing of the wire handle and tubular grip depicted in FIG. 3A.
Figure 4:
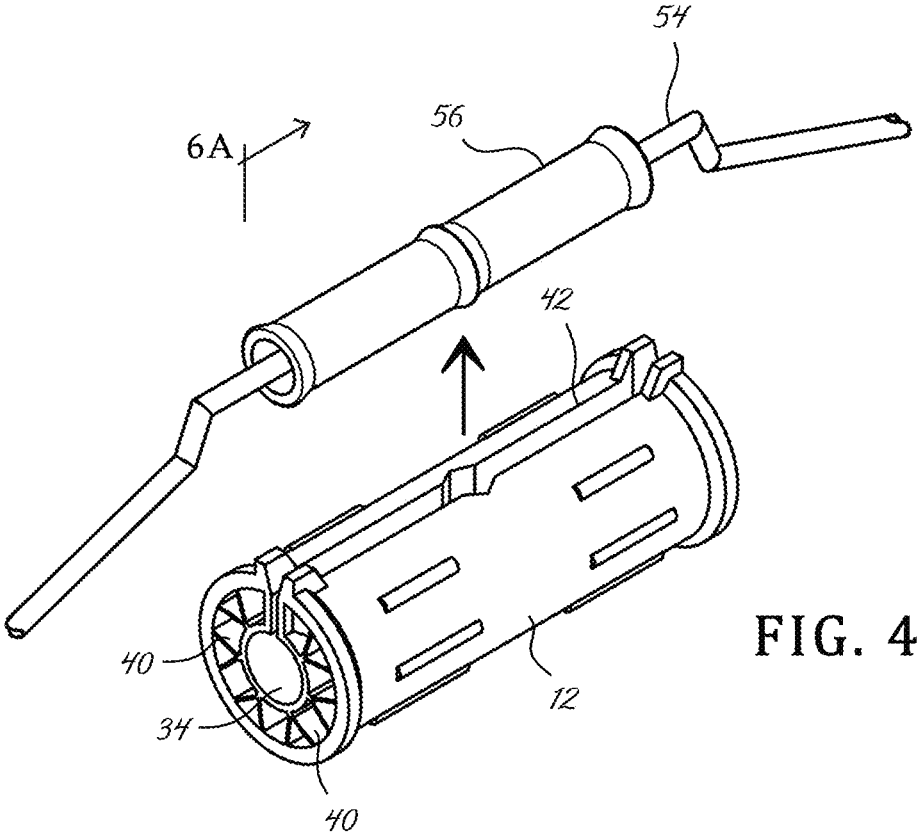
FIG. 4 is a perspective illustration of the auxiliary gripping member positioned for receiving a tubular grip.
Figure 5:
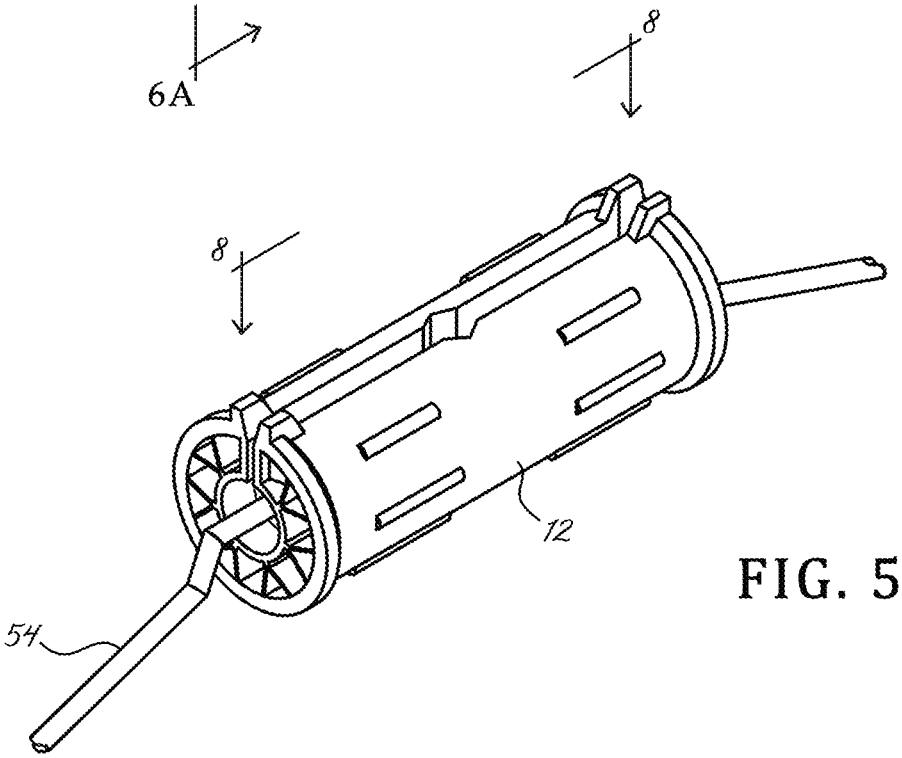
FIG. 5 is a perspective illustration similar to FIG. 4 showing the tubular grip after receiving the auxiliary gripping member.
Figure 6A:
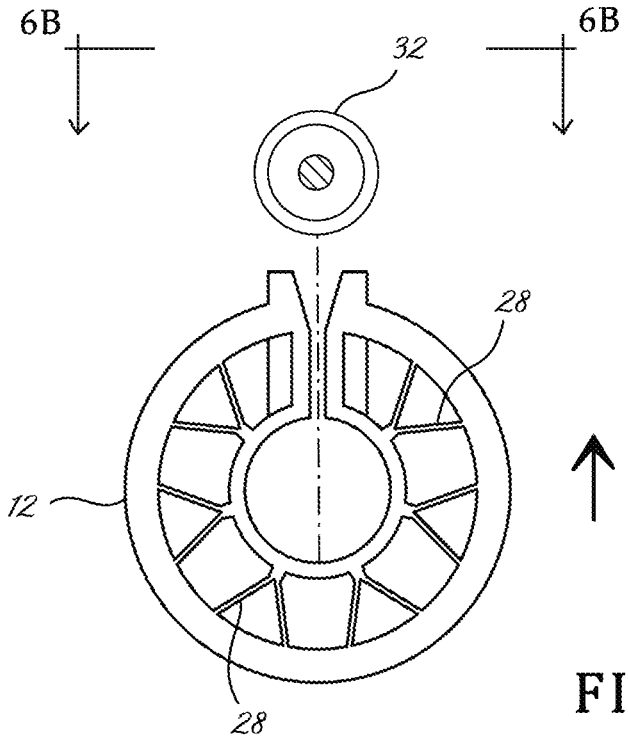
FIG. 6A is a cross sectional view taken along lines 6A-6A of FIG. 4.
Figure 6B:
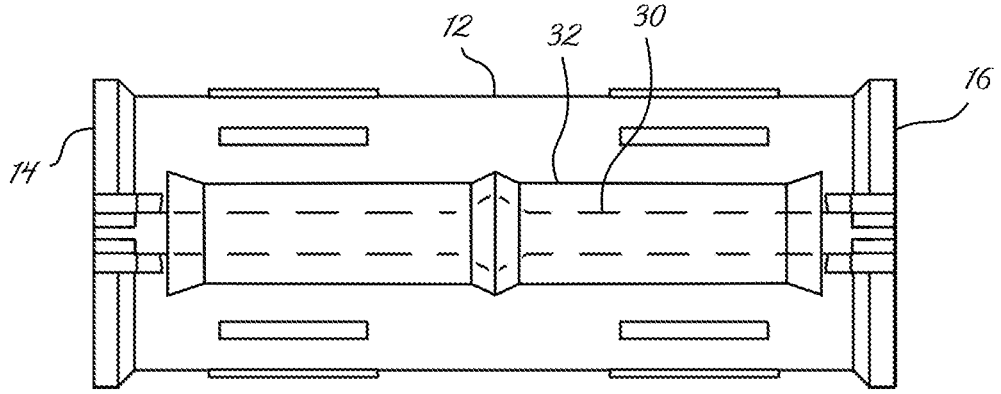
FIG. 6B is a plan view taken along lines 6B-6B of FIG. 6A.
Figure 7A:
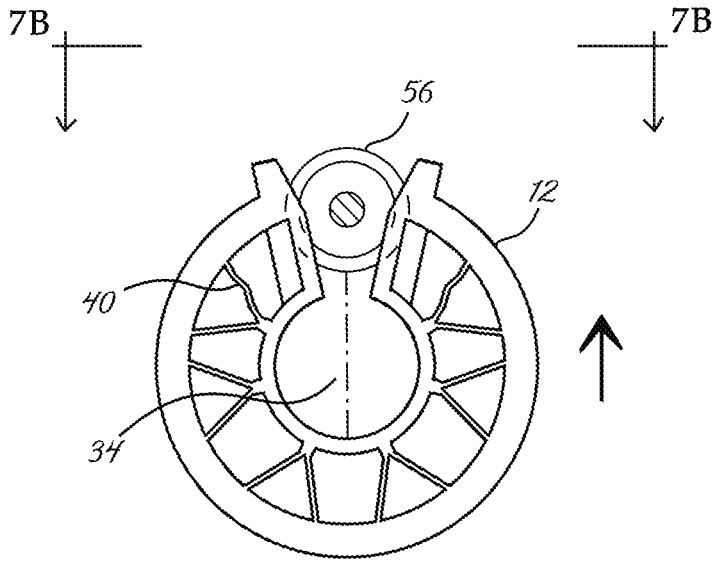
FIG. 7A is a side elevational view similar to FIG. 6A, however, now showing the auxiliary gripping member moved upward and initiating the receiving of the tubular grip.
Figure 7B:
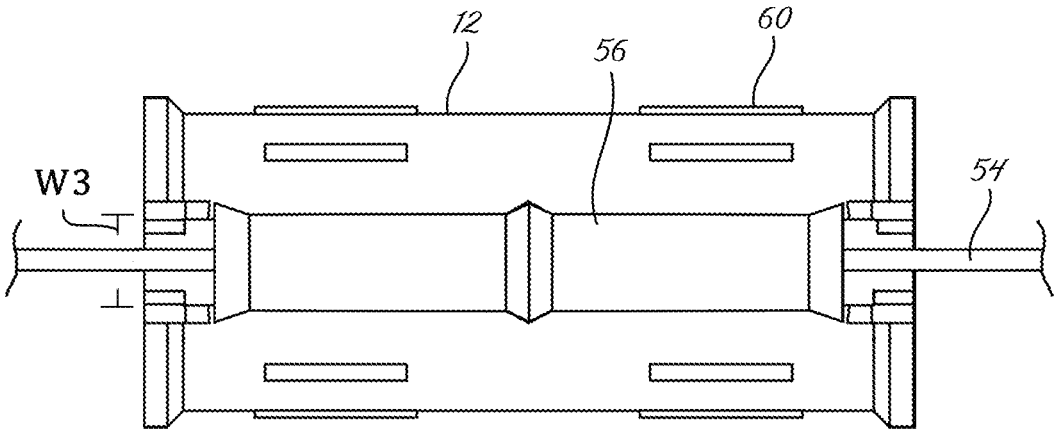
FIG. 7B is a plan view taken along lines 7B-7B of FIG. 7A.
Figure 8:
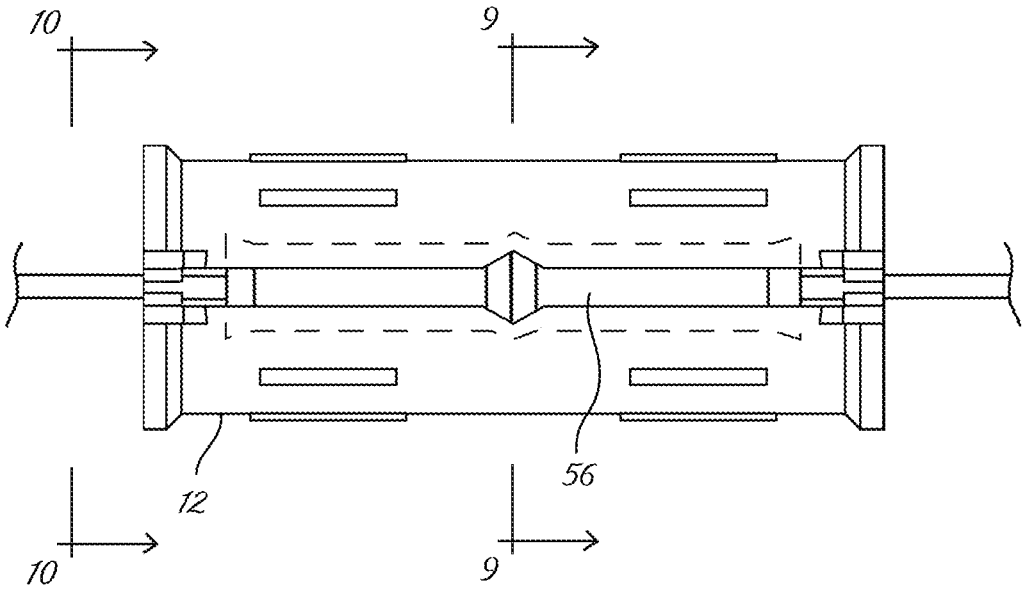
FIG. 8 is a plan view taken along lines 8-8 of FIG. 5.
Figure 9:
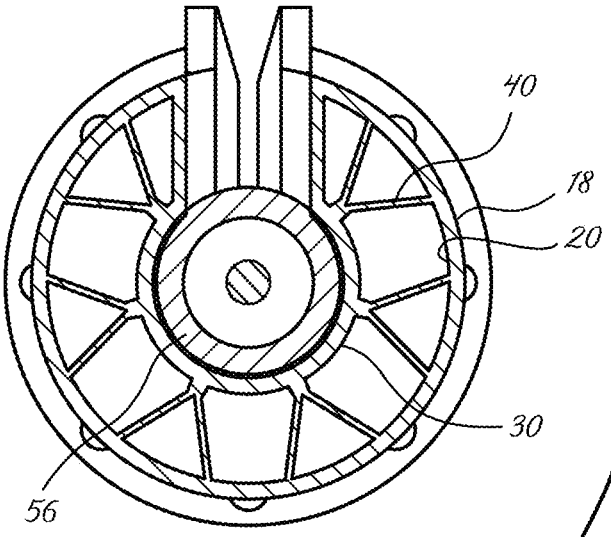
FIG. 9 is a cross sectional view taken along lines 9-9 of FIG. 8.

Referring now to the prior art in FIGS. 3A and 3B, a carrying member 50 is shown attached to a five-gallon bucket 52. Alternatively, carrying member 50 may also be attached to a variety of carriable containers, pails, or like buckets (not shown). The carrying member includes a wire handle 54 and a tubular container grip 56. The tubular container grip has a grip length L3 and a diameter W2.

As shown in FIGS. 4-9, the channel allows the outer and inner collars to resiliently deform for removably receiving the tubular container grips of carrying members. Specifically, first length L1 and channel length L2 are greater than grip length L3 and first width W1 is less than grip diameter W2. In this specific manner, when channel 42 is aligned and forced into the tubular container grip, as is best shown in FIGS. 7A and 7B, the channel resiliently expands from first width W1 to a second width W3 thereby allowing the tubular container grip to be received and positioned within passage 34. To remove the tubular container grip from the passage, the receiving and positioning is reversed and the tubular container grip can be forced back through the channel. Although the channel of invention disclosed herein has a generally rectangular shape, it should be stated that the shape of the channel can be further adapted to match the contoured profiles of the various handle members.

Figure 10:
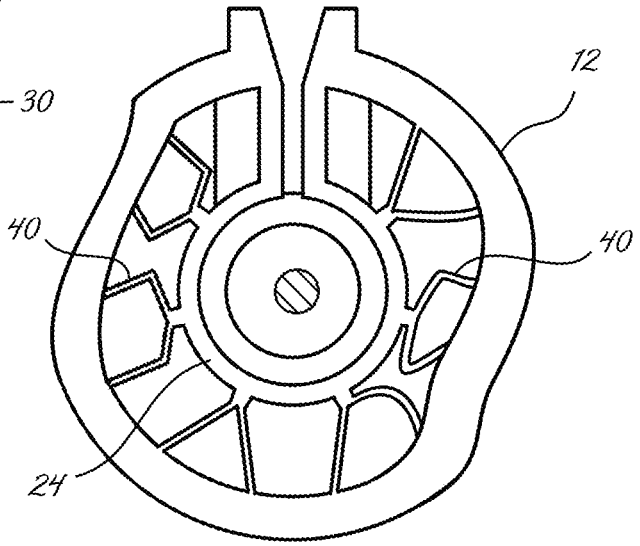
FIG. 10 is a cross sectional view taken along lines 10-10 of FIG. 8, however illustrating how the auxiliary gripping member resiliently deforms inwardly when gripped by a user.

Now referring to FIG. 10, which further illustrates the inward deformation of the outer collar and the plurality of ribs when gripped by the hand (not shown) of the user. Such resilient deformation ergonomically conforms to the hand which increases gripping capabilities and comfort for the user.

As shown throughout the FIGS., the plurality of ribs which interconnect the inner and outer collars define a resiliently deformable radial pattern. In this preferred embodiment, the resiliently deformable radial pattern is a plurality of geometric shapes. In an alternate embodiment of the invention, the resiliently deformable radial pattern may be a plurality of equispaced V-shaped lines or a similar configuration so long as such pattern allows for resilient deformation of the outer collar and the plurality of ribs when gripped by the user.

In another alternate embodiment of the invention, the exterior surface of the outer collar may include a plurality of elongate projections 60 thereby further increasing gripping capabilities for the user.

Figure 11:
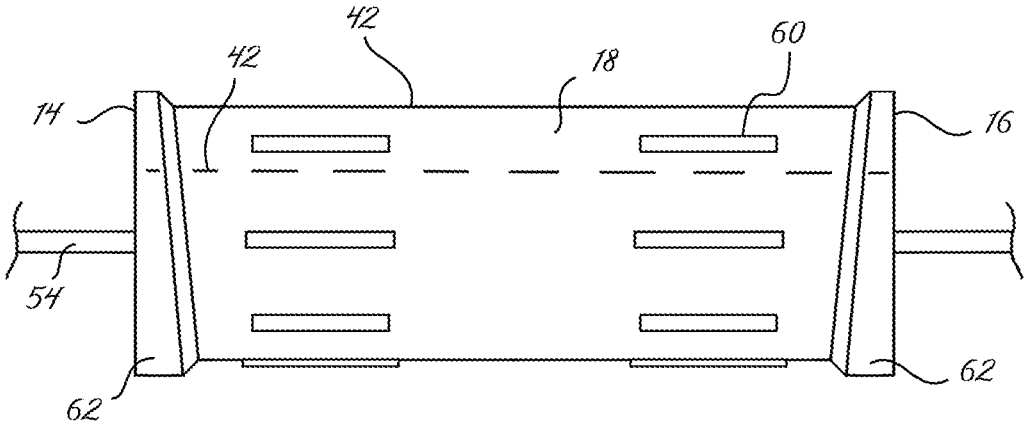
FIG. 11 is a side elevational view of an alternate embodiment of the invention.

In yet another alternate embodiment of the invention, the first and second ends of the outer collar may project outwardly in the form of annular rings 62. As shown in FIG. 11, each annular ring has a greatest circumferential thickness opposite from the channel for providing an unbalanced weight. In this manner, the annular rings provide additional weight for rotating and positioning the channel into an upwards position which is preferred for gripping. Therefore, maintaining the preferred upward position throughout rotation of the handle member provides users additional convenience benefits.

In another alternate embodiment of the invention, the annular rings may extend radially inward into the channel for aligning the tubular container grips with the channel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An auxiliary gripping member comprising:

an outer collar constructed of a resiliently deformable material, said outer collar having a first end and a second end separated by a first length, said outer collar having an exterior surface with an exterior diameter and an interior surface with an interior diameter, said outer collar having a longitudinal axis;

an inner collar constructed of a resiliently deformable material, said inner collar having a first end and a second end, said inner collar having an exterior surface with an exterior diameter and an interior surface with an interior diameter, said interior surface of the inner collar defining a passage extending along an axis which is co-axially aligned with said longitudinal axis of the outer collar;

said interior diameter of the outer collar being greater than said exterior diameter of the inner collar thereby creating a gap between said outer and inner collars;

a plurality of ribs constructed of a resiliently deformable material, said plurality of ribs disposed within said gap, said plurality of ribs interconnecting said exterior surface of the inner collar and said interior surface of the outer collar;

a channel disposed within said outer and inner collars, said channel extending longitudally along said first length and opening at one side into said passage and opening at an opposite side exteriorly of said outer collar, said channel having a first width; and wherein said plurality of ribs and said outer collar are resiliently deformable when gripped by a user's hand.

2. The gripping member as set forth in claim 1 wherein said first width of the channel is less than said interior diameter of the inner collar.

3. The gripping member as set forth in claim 2 wherein said outer and inner collars being resiliently deformable thereby allowing said first width of the channel to expand to a second width for receiving and positioning a tubular container grip within said passage.

4. The gripping member as set forth in claim 1 wherein said first and second ends of the inner collar are vertically aligned with said first and second ends of the outer collar respectively.

5. The gripping member as set forth in claim 1 wherein said interconnecting of each of the plurality of ribs defines a resiliently deformable radial pattern extending longitudally along said first length.

6. The gripping member as set forth in claim 5 wherein such resiliently deformable radial pattern is a plurality of geometric shapes.

7. The gripping member as set forth in claim 5 wherein such resiliently deformable radial pattern is a plurality of equispaced V-shaped lines.

8. The gripping member as set forth in claim 1 wherein the outer collar and the inner collar and the plurality of ribs are integrally formed of a unitary, piece of material.

9. A resiliently deformable auxiliary gripping member for removably receiving tubular container grips and for providing increased gripping capabilities, said resiliently deformable auxiliary gripping member comprising:

an outer collar having a first end and a second end separated by a first length, said outer collar having an exterior surface with an exterior diameter and an interior surface with an interior diameter, said outer collar having a longitudinal axis;

an inner collar having a first end and a second end, said first and second ends of the inner collar being vertically aligned with said first and second ends of the outer collar respectively, said inner collar having an exterior surface with an exterior diameter and an interior surface with an interior diameter, said interior surface of the inner collar defining a passage extending along an axis which is co-axially aligned with said longitudinal axis of the outer collar;

said interior diameter of the outer collar being greater than said exterior diameter of the inner collar thereby creating a gap between said outer collar and said inner collar;

a plurality of ribs disposed within said gap, said plurality of ribs extending longitudally between said first and second ends of the outer collar, said plurality of ribs radially interconnecting said exterior surface of the inner collar and said interior surface of the outer collar;

a channel disposed within said outer and inner collars, said channel extending longitudally along said first length and through said first and second ends of the outer collar and through said first and second ends of the inner collar, said channel opening interiorly at one side into said passage and opening at an opposite side exteriorly of said outer collar, said channel having a first width, said first width being less than said interior diameter of the inner collar;

wherein said outer collar and said inner collar and said plurality of ribs are integrally formed of a unitary, piece of resiliently deformable material;

wherein said interconnecting of each of the plurality of ribs defines a resiliently deformable radial pattern;

wherein said resiliently deformable radial pattern is a plurality of equispaced geometric shapes;

wherein said outer and inner collars are resiliently deformable thereby allowing said first width of the channel to expand to a second width being greater than said interior diameter of the inner collar for receiving and positioning a tubular container grip within said passage; and wherein said plurality of ribs and said outer collar are resiliently deformable for conforming to a hand of a user when gripped.

10. The gripping member as set forth in claim 9 wherein said first and second ends of the outer collar project outwardly from said exterior surface forming annular rings.

11. The gripping member as set forth in claim 10 wherein said annular rings have a greatest circumferential thickness opposite from said channel.

12. The gripping member as set forth in claim 11 wherein said annular rings provide unbalanced weight for rotationally positioning said channel upwards into a preferred gripping position for said hand.

* * * * *